US010329993B2

(12) United States Patent
Fletcher et al.

(10) Patent No.: US 10,329,993 B2
(45) Date of Patent: Jun. 25, 2019

(54) VEHICLE EXHAUST ASSEMBLY

(71) Applicant: Jaguar Land Rover Limited, Coventry, Warwickshire (GB)

(72) Inventors: Simon Fletcher, Coventry (GB); Dean Petley, Coventry (GB)

(73) Assignee: Jaguar Land Rover Limited, Coventry, Warwickshire (GB)

( * ) Notice: Subject to any disclaimer, the term of this patent is extended or adjusted under 35 U.S.C. 154(b) by 0 days.

(21) Appl. No.: 15/570,882

(22) PCT Filed: Jun. 8, 2016

(86) PCT No.: PCT/EP2016/062995
§ 371 (c)(1),
(2) Date: Oct. 31, 2017

(87) PCT Pub. No.: WO2016/198436
PCT Pub. Date: Dec. 15, 2016

(65) Prior Publication Data

US 2018/0291795 A1 Oct. 11, 2018

(30) Foreign Application Priority Data

Jun. 12, 2015 (GB) ..... 1510233.8

(51) Int. Cl.
*F01N 13/18* (2010.01)
*F01N 1/00* (2006.01)
(Continued)

(52) U.S. Cl.
CPC ..... *F01N 13/1844* (2013.01); *F01N 1/00* (2013.01); *F01N 1/06* (2013.01); *F01N 1/065* (2013.01);
(Continued)

(58) Field of Classification Search
CPC ..... F01N 13/1811; F01N 13/1816; F01N 13/1822; F01N 13/1844
See application file for complete search history.

(56) References Cited

U.S. PATENT DOCUMENTS 4,315,558 A 2/1982 Katayama
5,323,989 A 6/1994 Hamada et al.
(Continued)

FOREIGN PATENT DOCUMENTS

FR 2 869 351 A1 10/2005
FR 2 905 726 A1 3/2008
(Continued)

OTHER PUBLICATIONS

Machine translation of JPS5670425U, accessed Jan. 16, 2019. (Year: 2019).*
(Continued)

*Primary Examiner* — Jonathan R Matthias
(74) *Attorney, Agent, or Firm* — Myers Bigel, P.A.

(57) ABSTRACT

The present disclosure relates to a vehicle exhaust assembly (1) for an internal combustion engine. The vehicle exhaust assembly (1) comprises an exhaust system (3) and an exhaust mounting assembly (4) for mounting the exhaust system (3) to a vehicle (2). The exhaust system (3) comprises an inlet section (5) for connection to the internal combustion engine; an intermediate section (6) connected to the inlet section (5); an outlet section (7) for exhausting gases from the internal combustion engine; and one or more exhaust decoupler (8) for decoupling the intermediate section (6) from the inlet section (5). The exhaust mounting assembly (4) comprises one or more first isolator device (20-1, 20-2) for resiliently constraining movement of the intermediate section (6) of the exhaust system (3) in a longitudinal direction; and one or more second isolator device (20-3, 20-4) for resiliently constraining movement of
(Continued)

the outlet section (7) of the vehicle (2) exhaust in a transverse direction. The present disclosure also relates to a vehicle (2) including a vehicle exhaust assembly (1).

20 Claims, 6 Drawing Sheets

(51) Int. Cl.
*F01N 1/06* (2006.01)
*F01N 13/02* (2010.01)
*F01N 13/16* (2010.01)

(52) U.S. Cl.
CPC ..... *F01N 13/02* (2013.01); *F01N 13/16* (2013.01); *F01N 13/1811* (2013.01); *F01N 13/1816* (2013.01); *F01N 13/1822* (2013.01); *F01N 13/1861* (2013.01); *F01N 2340/04* (2013.01); *F01N 2530/00* (2013.01)

(56) References Cited

U.S. PATENT DOCUMENTS

| | | | |
|---|---|---|---|
| 6,058,702 | A | 5/2000 | Alexnat et al. |
| 6,173,800 | B1 | 1/2001 | Steenackers et al. |
| 6,298,935 | B1 | 10/2001 | Steenackers et al. |
| 6,554,321 | B1 | 4/2003 | Boisseau et al. |
| 2003/0024584 | A1 | 2/2003 | Godel et al. |
| 2009/0230601 | A1 | 9/2009 | Lenda |

FOREIGN PATENT DOCUMENTS

| | | | | |
|---|---|---|---|---|
| JP | 56070425 | U | * | 6/1981 |
| JP | 61-152523 | U | | 9/1986 |
| JP | 2-127729 | U | | 10/1990 |
| JP | 2000-9179 | A | | 1/2000 |
| JP | 2001-164933 | A | | 6/2001 |
| JP | 2004-84840 | A | | 3/2004 |
| JP | 2004-510935 | A | | 4/2004 |
| JP | 2006-307695 | A | | 11/2006 |
| JP | 2009-52501 | A | | 3/2009 |
| JP | 2010-502908 | A | | 1/2010 |
| WO | WO 2008/027100 | A2 | | 3/2008 |

OTHER PUBLICATIONS

Patents Act 1977: Combined Search and Examination Report under Sections 17 and 18(3), UKIPO Application No. GB1510233.8, dated Dec. 14, 2015, 8 pp.
International Search Report and Written Opinion of the International Searching Authority, International Application No. PCT/EP2016/062995, dated Aug. 11, 2016, 14 pp.
Office Action with English Language Summary, JP Application No. 2017-552020, dated Oct. 2, 2018, 6 pp.

* cited by examiner 28-1
24-3
20-3
23-3
22-3
4
29-1
19-1
7
25-3
19-1
18-1
6
28-2
29-2
19-2
4
20-4
25-4
18-2
14-2
14-1
26-1
20-1
22-1
23-1
27-1
25-1
21
16-1
24-1
X
16-2
20-2
4
20-1
21
16-1
17
15
11
12
8
10
22-2
13
8
9
5
3
X
Z
Y

VEHICLE EXHAUST ASSEMBLY

RELATED APPLICATIONS

This application is a 35 U.S.C. § 371 national stage application of PCT Application No. PCT/EP2016/062995, filed on Jun. 8, 2016, which claims priority from Great Britain Patent Application No 1510233.8, filed on Jun. 12, 2015, the contents of which are incorporated herein by reference in their entireties. The above-referenced PCT International Application was published in the English language as International Publication No. WO 2016/198436 A1 on Dec. 15, 2016.

TECHNICAL FIELD

The present disclosure relates to a vehicle exhaust assembly; and to a vehicle comprising a vehicle exhaust assembly.

BACKGROUND

Automotive vehicles having internal combustion engines are often provided with an exhaust system to expel exhaust gases at the rear of the vehicle. The exhaust system typically includes one or more conduits for porting exhaust gases from the internal combustion engine to one or more tail pipe. The exhaust system can also include after-treatment devices, such as a catalytic converter for trapping particles suspended in the exhaust gases; and one or more silencer for reducing exhaust noise. A typical exhaust system for a road vehicle is made from stainless steel, having a gauge thickness of 1.2 mm or 1.5 mm resulting in a significant mass.

In order to reduce the mass of the exhaust system, it is known to use materials other than stainless steel. For example, the exhaust system can be fabricated from titanium, but this typically requires specialised fabrication techniques and is more expensive to produce. There are additional obstacles to reducing the mass of the exhaust system. Notably, larger and more complex after-treatment devices are required to meet increasingly stringent emissions legislation. Moreover, there is an on-going desire to reduce acoustic outputs and/or to tune the acoustic outputs to refine the soundscape within the vehicle. These requirements typically result in larger and more complex exhaust systems.

It is against this backdrop that the present invention has been conceived. At least in certain embodiments, the present invention relates to an exhaust system configured to have a lower mass that prior art systems.

SUMMARY OF THE INVENTION

Aspects of the present invention relate to a vehicle exhaust assembly; and to a vehicle comprising a vehicle exhaust assembly.

According to a further aspect of the present invention there is provided a vehicle exhaust assembly for an internal combustion engine, the vehicle exhaust assembly comprising an exhaust system and an exhaust mounting assembly for mounting the exhaust system, wherein:

the exhaust system comprises:

- an inlet section for connection to the internal combustion engine;
- an intermediate section connected to the inlet section;
- an outlet section for exhausting gases from the internal combustion engine; and
- one or more exhaust decoupler for decoupling the intermediate section from the inlet section;

the exhaust mounting assembly comprises:

- one or more first isolator device for resiliently constraining movement of the intermediate section of the exhaust system in a longitudinal direction; and
- one or more second isolator device for resiliently constraining movement of the outlet section of the vehicle exhaust in a transverse direction. In use, vibrations are transmitted to the exhaust system from two primary excitations sources, namely the internal combustion engine and the road surface. These excitations cause the exhaust system to respond in a modal fashion or to impart global 'cantilevering' loads, since the exhaust system is more mobile than the internal combustion engine or body structure to which it is attached. The vehicle exhaust assembly according to certain embodiments of the present invention can reduce mechanical loads on the exhaust system. In particular, the exhaust mounting assembly is configured to support the exhaust system to reduce mechanical loading. At least in certain embodiments, this allows the mass of the exhaust system to be reduced. For example, if the mechanical loading on the exhaust system can be reduced or removed, the gauge of the materials used to form the exhaust system can be reduced.

The one or more first isolator device can comprise a first resilient isolator element. The first resilient isolator element can, for example, be moulded from an elastomeric material. The elastomeric material can be moulded into a rigid housing or frame, for example using an over-moulding technique. In an alternate arrangement, the first isolator device can be in the form of a first pendulum isolator device. The first pendulum isolator device can be suspended by two or more pins. Other types of isolator device can usefully be employed in the exhaust system.

The one or more first isolator device can have an axial dynamic stiffness in said longitudinal direction of less than or equal to 60 N/mm up to an excitation frequency of 180 Hz. The one or more first isolator device can provide greater resilient constraint for the intermediate section in said longitudinal direction than in a vertical direction. The one or more first isolator device can at least substantially inhibit movement of the intermediate section in said transverse direction. The one or more first resilient isolator device can be configured to provide greater resilient constraint in said longitudinal direction than in said vertical direction. The one or more first isolator device can be configured to support the intermediate section in said vertical direction at least substantially without resiliently constraining movement in the vertical direction.

The one or more second isolator device can comprise a second resilient isolator element. The second resilient isolator element can, for example, be moulded from an elastomeric material. The elastomeric material can be moulded into a rigid housing or frame, for example using an over-moulding technique. In an alternate arrangement, the second isolator device can be in the form of a second pendulum isolator device. The second pendulum isolator device can be suspended by two or more pins. Other types of isolator device can usefully be employed in the exhaust system.

The first isolator device and the one or more second isolator device can have like configurations. For example, the same isolator element can be used in the first and second resilient isolator devices.

The one or more second isolator device can have an axial dynamic stiffness in said transverse direction of less than or equal to 60 N/mm up to an excitation frequency of 180 Hz. The second isolator device can provide greater resilient constraint for the rear section in said transverse direction than in a vertical direction. The second isolator device can at least substantially inhibit movement of the rear section in said longitudinal direction. The second resilient isolator device can be configured to provide greater resilient constraint in said transverse direction than in said vertical direction. The second isolator device can be configured to support the intermediate section in said vertical direction at least substantially without resiliently constraining movement in the vertical direction.

The exhaust mounting assembly may comprise one of the first isolator devices only. In such an embodiment, the positioning and dynamic stiffness of the one first isolator device may be such that a single such device is sufficient to support the intermediate section and to resiliently restrain movement in the longitudinal direction. The one first isolator device may be positioned near to the intermediate section centre of mass, for example near to a silencer. As only one first isolator device is needed, the weight of the exhaust assembly is kept to a minimum.

The exhaust mounting assembly may comprise one of the second isolator devices only. In such an embodiment, the positioning and dynamic stiffness of the one second isolator device may be such that a single such device is sufficient to support the outlet section and to resiliently restrain movement in the transverse direction. The one second isolator device may be positioned near to the outlet section centre of mass, for example near to a silencer. Such an embodiment may be particularly useful in an exhaust assembly comprising a single tailpipe only. As only one second isolator device is needed, the weight of the exhaust assembly is kept to a minimum.

The exhaust mounting assembly may comprise two of the second isolator devices only. In such an embodiment, the positioning and dynamic stiffness of the two second isolator devices may be such that two such devices are sufficient to support the outlet section and to resiliently restrain movement in the transverse direction. The two second isolator devices may be positioned near to respective silencers of the outlet section, for example. Such an embodiment may be particularly useful in a twin-sided exhaust assembly comprising first and second tailpipes. As only two second isolator devices are needed, the weight of the exhaust assembly is kept to a minimum.

The exhaust system can comprise a plurality of exhaust decouplers. The exhaust decouplers can be disposed in a series configuration. Alternatively, the exhaust decouplers can be disposed in a parallel configuration. The inlet section can comprise a plurality of conduits for connection to the internal combustion engine, the conduits each comprising one of said exhaust decoupler.

The one or more exhaust decoupler can each comprise a flexible conduit. The one or more exhaust decoupler can comprise a convoluted tube to form a sealed fluid duct. Alternatively, or in addition, the one or more exhaust decoupler can each comprise a flexible metal braided (or knitted) conduit. The braided (or knitted) conduit can form an outer sleeve. The outer sleeve can be operative to provide dynamic damping and/or to limit constraining functions. The one or more exhaust decoupler can have a length greater than or equal to 180 mm. The exhaust decoupler can have a length of 200 mm. The one or more exhaust decoupler can be configured to reduce excitation of the intermediate section to less than 0.18 mm at frequencies less than or equal to 500 Hz. The one or more exhaust decoupler can each have an axial dynamic stiffness of less than or equal to 50 N/mm up to an excitation frequency of 160 Hz. The one or more exhaust decoupler can each have a lateral dynamic stiffness of less than or equal to 60 N/mm up to an excitation frequency of 180 Hz.

At least in certain embodiments, the exhaust system can comprise one or more second exhaust decoupler. For example, one or more second exhaust decoupler can be provided in said intermediate section and/or in said outlet section. One or more second exhaust decoupler can be provided to decouple the intermediate section from the outlet section. A second exhaust decoupler could be provided in the exhaust system within the after-treatment system; and/or between an after-treatment device and an acoustic silencer. The after-treatment device and the acoustic silencer could be decoupled from each other.

The exhaust system may comprise one of the exhaust decouplers only. In such an embodiment, the positioning and dynamic stiffness of the one exhaust decoupler may be such that a single such device is sufficient to decouple the intermediate section from the inlet section.

The exhaust system can be made of metal sheet having a gauge thickness of between 0.4 mm and 0.7 mm. The exhaust system can be made of stainless steel.

The intermediate section of the exhaust system can comprise an after-treatment device, such as a catalytic converter. The intermediate section can comprise one or more intermediate conduit. The after-treatment device has an external wall which can have a plurality of out-of-plane features. In particular, the external wall can comprise a plurality of like indentations. The indentations can project inwardly and can be arranged in a regular, or irregular (for example, a Computer Aided Engineering (CAE) derived) pattern. For example, the indentations can be in the form of hexagonal indentations arranged in an interlocking pattern.

The outlet section and/or the intermediate of the exhaust system can comprise one or more acoustic silencer. Each acoustic silencer can have a sidewall having a structured composition, for example comprising a plurality of out-of-plane features. For example, the sidewall can comprise a plurality of outwardly directed projections. The outwardly directed projections can be arranged in a repeating pattern. For example, the structured sheet material can comprise an array of polygonal projections arranged in an interlocking pattern.

The gauge thickness of the sidewall of the one or more acoustic silencer may be less than the gauge thickness of a conduit of at least one of the intermediate section and the outlet section.

The outlet section of the exhaust system can comprise at least one active acoustic control device.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present invention will now be described, by way of example only, with reference to the accompanying figures, in which.

DETAILED DESCRIPTION

Figure 1:
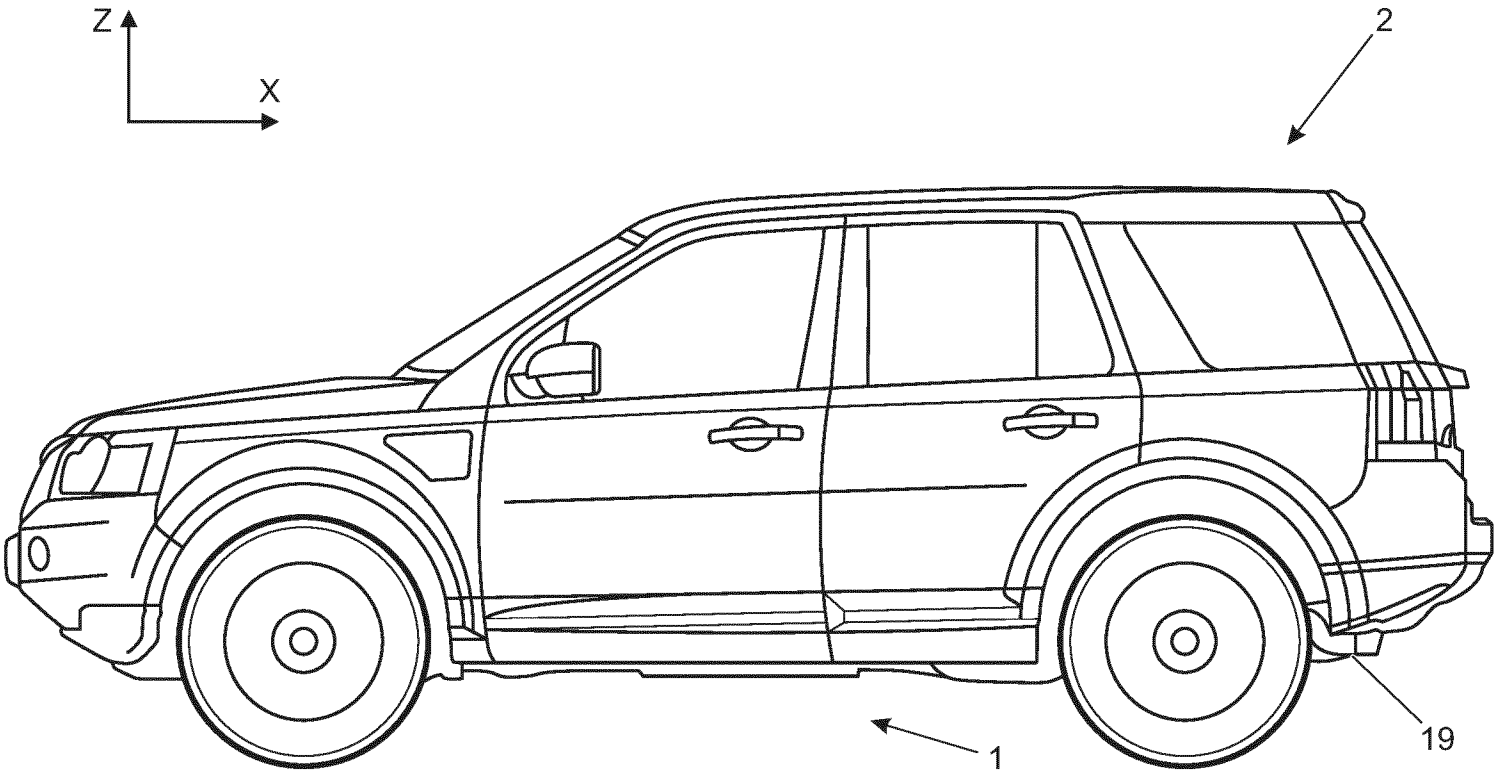
FIG. 1 shows a vehicle incorporating a vehicle exhaust assembly in accordance with an embodiment of the present invention.

A vehicle exhaust assembly 1 in accordance with an embodiment of the present invention will now be described with reference to the accompanying figures. The vehicle exhaust assembly 1 in the present embodiment is for use in a vehicle 2 to expel exhaust gases from an internal combustion engine (not shown). The internal combustion engine is front-mounted in the vehicle 2 and the vehicle exhaust assembly 1 extends under the body of the vehicle 2, as shown schematically in FIG. 1. The vehicle 2 is an automobile in the present embodiment, but the techniques and apparatus described herein can be applied to other types of vehicles.

A vehicle reference frame comprises a longitudinal axis X, a transverse axis Y and a vertical axis Z. The vehicle exhaust assembly 1 is described herein using the vehicle reference frame. The terms longitudinal, transverse and vertical (and derivatives thereof) used herein correspond to the vehicle reference frame.

Figures 2A, 2B, 2C, 2D:
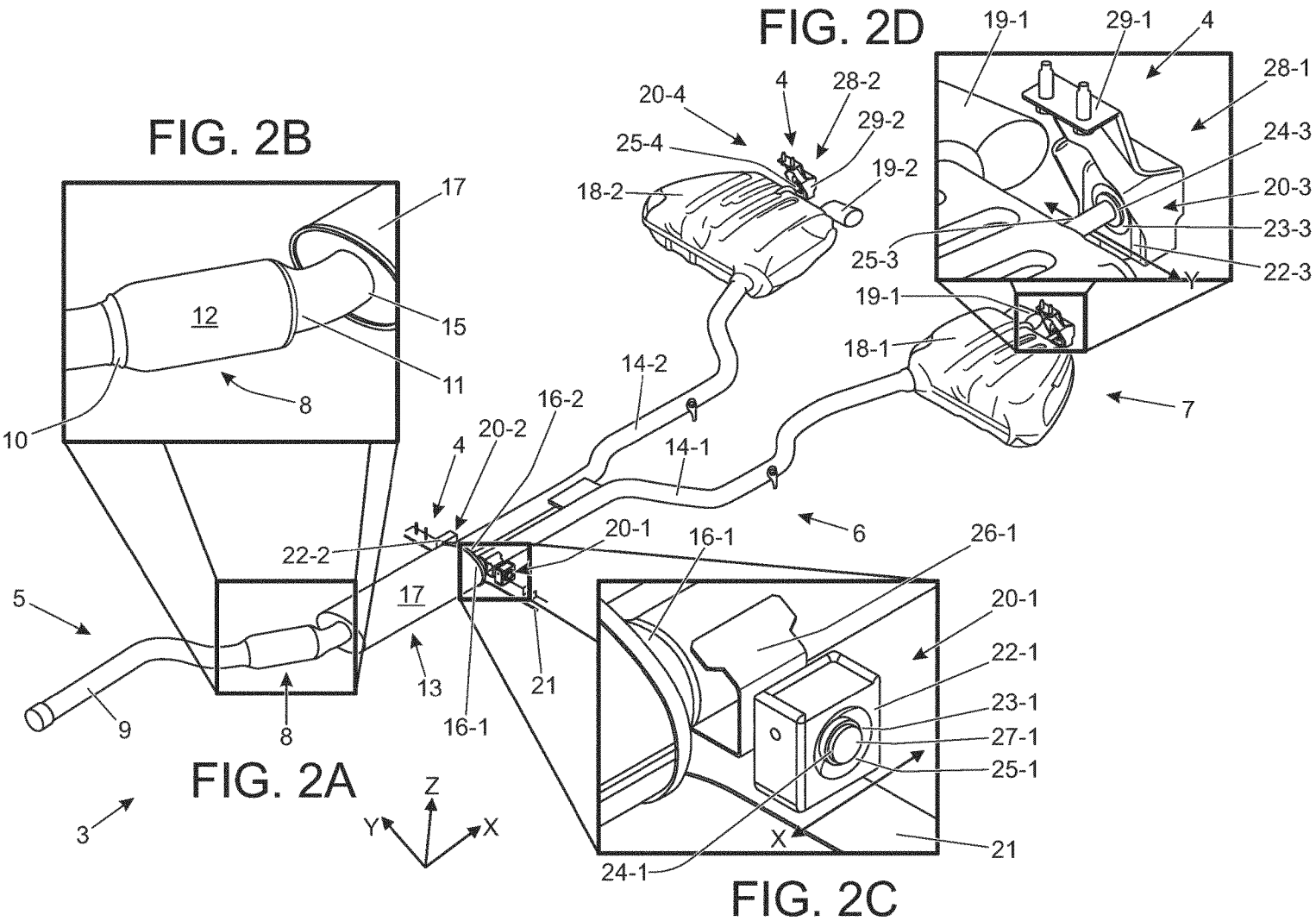
FIGS. 2A-D show perspective views of the vehicle exhaust assembly shown in FIG. 1.

As shown in FIG. 2A, the vehicle exhaust assembly 1 comprises an exhaust system 3 and an exhaust mounting assembly 4. The exhaust system 3 routes exhaust gases from the internal combustion engine to the rear of the vehicle 2. The exhaust system 3 comprises an inlet section 5, an intermediate section 6, and an outlet section 7. The inlet section 5 comprises an exhaust decoupler 8 and an inlet conduit 9. As shown in FIG. 2B, the exhaust decoupler 8 is a flexible coupling (providing a super-soft coupling element) and comprises a decoupler inlet 10, a decoupler outlet 11 and a decoupler sidewall 12. The exhaust decoupler 8 forms a flexible conduit for reducing the transmittal of vibrations into the intermediate section 6 of the exhaust system 3. The decoupler sidewall 12 in the present embodiment is formed by a flexible metal braid. The inlet conduit 9 is a stainless steel pipe having a diameter of 65 mm and is connected to an exhaust port of the internal combustion engine. The inlet conduit 9 is substantially rigid (i.e. inflexible) and connects to the decoupler inlet 10. In use, the vibrations are the result of two primary excitations in the form of the internal combustion engine and/or the road surface. The exhaust decoupler 8 is generally cylindrical and has a length (measured along a central longitudinal axis) of 180 mm. The decoupler outlet 11 has a diameter of 60 mm and connects to the intermediate section 6 of the exhaust system 3. In certain arrangements, more than one exhaust decoupler 8 could be provided in said inlet section 5.

The intermediate section 6 comprises a silencer 13, and first and second intermediate conduits 14-1, 14-2. The silencer 13 has one inlet 15, first and second outlets 16-1, 16-2, and a sidewall 17. The inlet 15 of the silencer 13 is connected to the decoupler outlet 11; and the first and second intermediate conduits 14-1, 14-2 are connected to the first and second outlets 16-1, 16-2 respectively. Optionally, an exhaust decoupler could be provided in each of said first and second intermediate conduits 14-1, 14-2. The first and second intermediate conduits 14-1, 14-2 each have a diameter of 70 mm and are made of stainless steel having a gauge thickness of 0.5 mm (or less). The first and second intermediate conduits 14-1, 14-2 are substantially rigid (i.e. inflexible).

The outlet section 7 comprises first and second exhaust silencers 18-1, 18-2, and first and second tailpipes 19-1, 19-2. The first and second intermediate conduits 14-1, 14-2 are connected to the first and second exhaust silencers 18-1, 18-2 respectively. The first and second tailpipes 19-1, 19-2 are disposed at the rear of the vehicle 2 to expel exhaust gases from the exhaust system 3.

The exhaust mounting assembly 4 provides a semi-rigid structure to support the exhaust system 3 under the body of the vehicle 2. The exhaust mounting assembly 4 comprises a first mounting assembly 20 for mounting the intermediate section 6 of the exhaust system 3. The first mounting assembly 20 comprises first and second opposing isolator devices 20-1, 20-2 fixedly attached to a mounting plate 21 which is fastened to the vehicle body. As shown in FIG. 2C, the first isolator device 20-1 comprises a first housing 22-1 and a first resilient isolator element 23-1. The first housing 22-1 is in the form of a rigid metal frame into which the first resilient isolator element 23-1 is over-moulded. The first resilient isolator element 23-1 has a first central aperture 24-1 for receiving a first mounting pin 25-1. The second isolator device 20-2 comprises a second housing 22-2 and a second resilient isolator element 23-2. The second housing 22-2 is in the form of a rigid metal frame into which the second resilient isolator element 23-2 is over-moulded. The second resilient isolator element 23-2 has a second central aperture (not visible) for receiving a second mounting pin (not visible). The first and second mounting pins 25-1, 25-2 are connected respectively to a first bracket 26-1 and a second bracket (not visible). The first and second brackets 26-1 are rigidly mounted to the first and second intermediate conduits 14-1, 14-2, for example by welding, brazing or mechanical fasteners. The first and second resilient isolator elements 23-1, 23-2 provide a semi-rigid mounting arrangement for the intermediate section 6 of the exhaust system 3. The first and second resilient isolator elements 23-1, 23-2 thereby form a localised body interface between the first and second brackets 26-1 and the first and second intermediate conduits 14-1, 14-2. Alternatively, or in addition, a metal retaining band or collar can be disposed around the outside of the silencer to mount the intermediate section 6. One or more additional mounting bracket can optionally be provided along the length of the first and second intermediate conduits 14-1, 14-2, for example at a mid-point, to provide additional support. The first and second mounting pins 25-1, 25-2 have a first head 27-1 and a second head (not visible) for engaging an outer surface of the first and second resilient isolator elements 23-1. The first and second isolator devices 20-1, 20-2 are disposed on opposing sides of the first and second intermediate conduits 14-1, 14-2. The first and second isolator devices 20-1, 20-2 are arranged coaxially such that the first and second central apertures 24-1 are disposed on a transverse axis parallel to the transverse axis Y of the vehicle 2.

When located in said first and second central apertures 24-1, the first and second mounting pins 25-1, 25-2 extend transversely.

Figure 3:
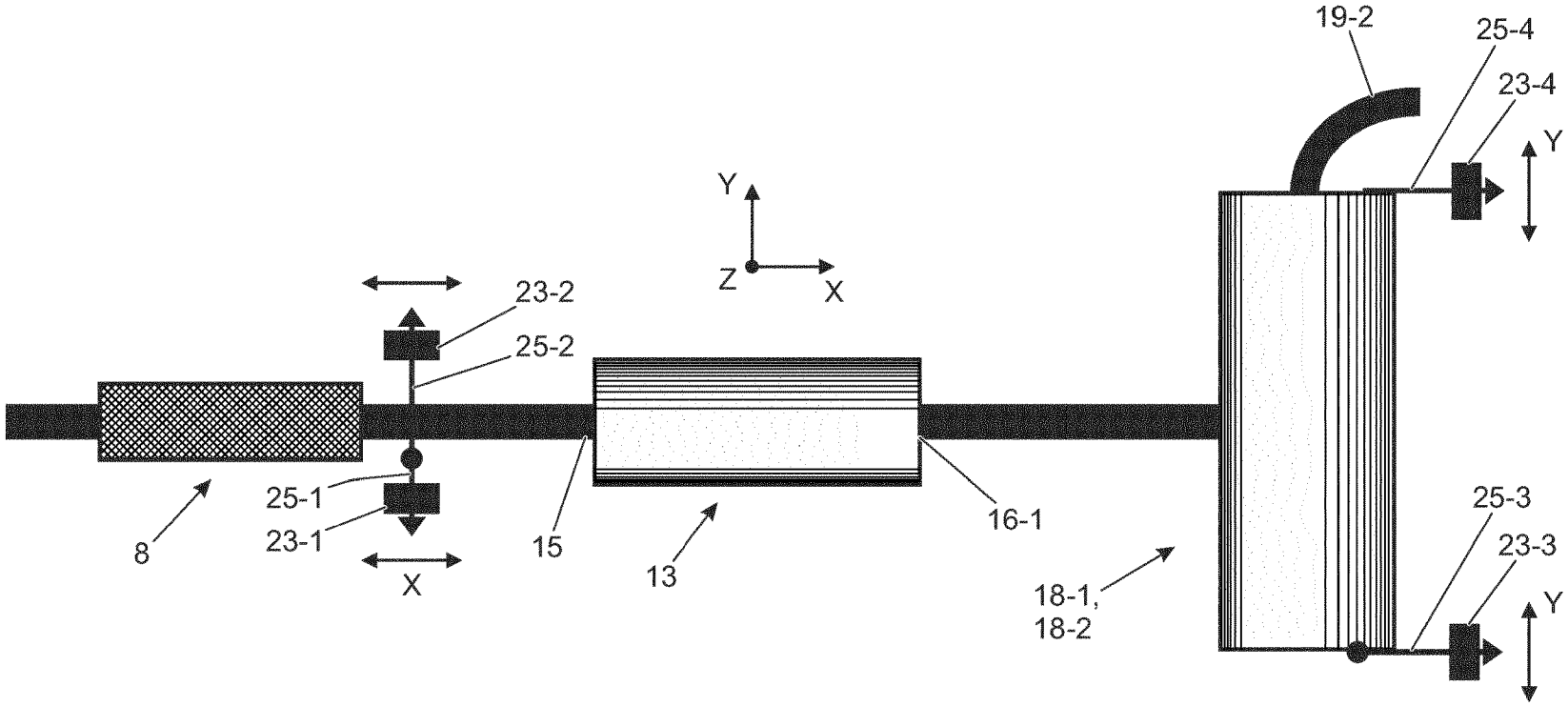
FIG. 3 shows a schematic representation of the vehicle exhaust assembly shown in FIG. 1.

As illustrated in FIGS. 2C and 3, the first and second resilient isolator elements 23-1, 23-2 are configured to resiliently constrain movement of the first and second mounting pins 25-1, 25-2 in a longitudinal direction (i.e. parallel to a longitudinal axis X of the vehicle 2), for example due to shunt loads resulting from dynamic acceleration/deceleration of the vehicle 2. By constraining movement in said longitudinal direction, the first and second isolator devices 20-1, 20-2 protect the exhaust decoupler 8 from over-extension and compression. The first and second resilient isolator elements 23-1, 23-2 are arranged to provide an axial dynamic stiffness in said longitudinal direction which is less than or equal to 60 N/mm up to an excitation frequency of 180 Hz. The first and second resilient isolator elements 23-1, 23-2 can also constrain or inhibit movement of the first and second mounting pins 25-1, 25-2 in a vertical direction (i.e. parallel to a vertical axis Z of the vehicle 2). The first and second resilient isolator elements 23-1, 23-2 can provide greater resilient constraint for the intermediate section 6 in the longitudinal direction than in the vertical direction. The first and second resilient isolator elements 23-1, 23-2 can at least substantially inhibit movement of the first and second mounting pins 25-1, 25-2 in a transverse direction (i.e. parallel to a transverse axis Y of the vehicle 2).

The exhaust mounting assembly 4 comprises a first silencer mounting assembly 28-1 for mounting the first exhaust silencer 18-1; and a second silencer mounting assembly 28-2 for mounting the second exhaust silencer 18-2. As shown in FIG. 2D, the first silencer mounting assembly 28-1 comprises a third isolator device 20-3 fixedly attached to a first hanger 29-1 which is fastened to the vehicle body. The third isolator device 20-3 comprises a third housing 22-3 and a third resilient isolator element 23-3. The third housing 22-3 is in the form of a rigid metal frame into which the third resilient isolator element 23-3 is overmoulded. The third resilient isolator element 23-3 has a fourth central aperture 24-3 for locating a third mounting pin 25-3. The third mounting pin 25-3 is fixedly mounted to the first exhaust silencer 18-1. The third mounting pin 25-3 has a third head (not visible) for engaging an outer surface of the third resilient isolator element 23-3. As illustrated in FIGS. 2D and 3, the third resilient isolator element 23-3 is configured to constrain movement of the third mounting pin 25-3 in a transverse direction (i.e. parallel to a transverse axis Y of the vehicle 2). The third resilient isolator element 23-3 can also constrain or inhibit movement of the third mounting pin 25-3 in a vertical direction (i.e. parallel to a vertical axis Z of the vehicle 2) and/or a longitudinal direction (i.e. parallel to a longitudinal axis X of the vehicle 2). The third resilient isolator element 23-3 can improve positional control of the first tailpipe 19-1. The appearance of the first tailpipe 19-1 in relation to the surrounding bumper/trim can be improved.

The second silencer mounting assembly 28-2 comprises a fourth isolator device 20-4 fixedly attached to a second hanger 29-2 which is fastened to the vehicle body. The fourth isolator device 20-4 comprises a fourth housing (not visible) and a fourth resilient isolator element 23-4. The fourth housing is in the form of a rigid metal frame into which the fourth resilient isolator element 23-4 is overmoulded. The fourth resilient isolator element 23-4 has a fourth central aperture (not visible) for locating a fourth mounting pin 25-4. The fourth mounting pin 25-4 is fixedly mounted to the first exhaust silencer 18-1. The fourth mounting pin 25-4 has a fourth head (not visible) for engaging an outer surface of the fourth resilient isolator element 23-4. The vehicle exhaust assembly 1 is shown schematically in FIG. 3, albeit with the second exhaust silencer 18-2 omitted for clarity.

As illustrated in FIG. 3, the fourth resilient isolator element 23-4 resiliently constrains movement of the fourth mounting pin 25-4 in a transverse direction (i.e. parallel to the transverse axis Y of the vehicle 2). The fourth resilient isolator element 23-4 is arranged to provide an axial dynamic stiffness in said transverse direction which is less than or equal to 60 N/mm up to an excitation frequency of 180 Hz. The fourth resilient isolator element 23-4 can also support the fourth mounting pin 25-4 in a vertical direction (i.e. parallel to the vertical axis Z of the vehicle 2). The fourth resilient isolator element 23-4 can provide greater resilient constraint in said transverse direction than in said vertical direction. The fourth resilient isolator element 23-4 can at least substantially inhibit movement of said fourth mounting pin 25-4 in a longitudinal direction (i.e. parallel to a longitudinal axis Y of the vehicle 2). The fourth resilient isolator element 23-4 can improve positional control of the second tailpipe 19-2. The appearance of the second tailpipe 19-2 in relation to the surrounding bumper/trim can be improved.

Figure 4A:
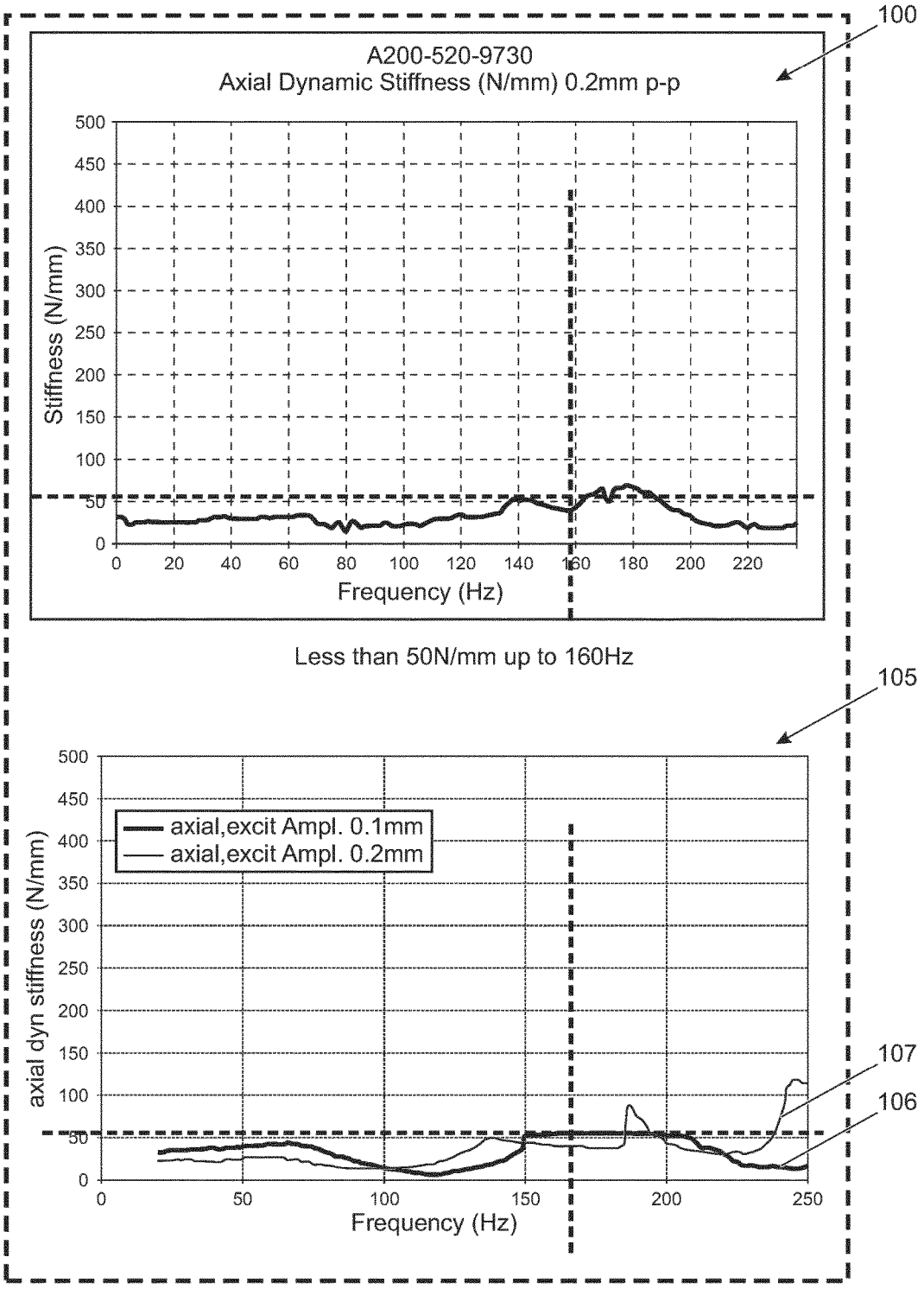
FIG. 4A shows first and second graphs showing the axial dynamic stiffness of an exhaust decoupler in the vehicle exhaust assembly shown in FIG. 1.
Figure 4B:
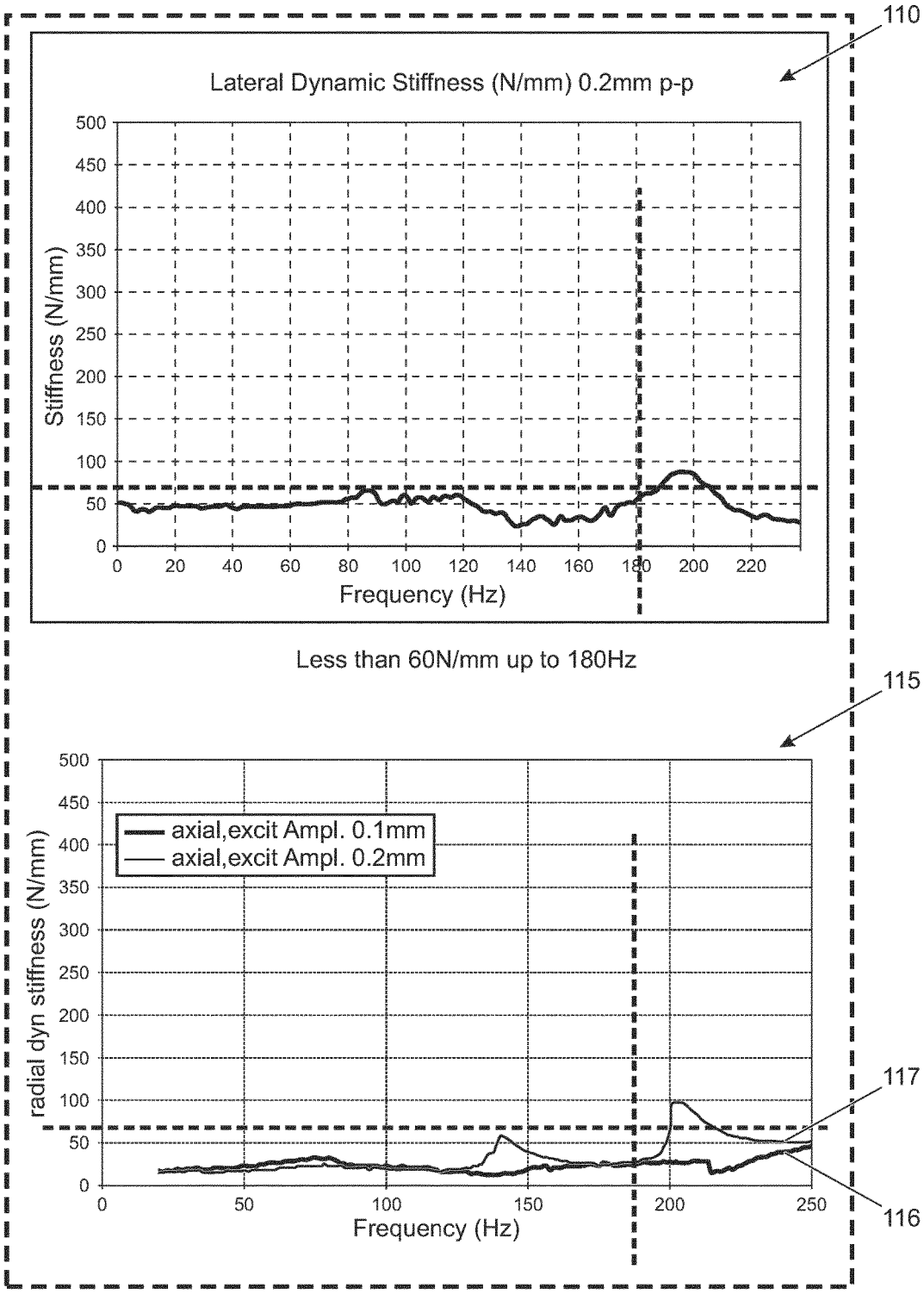
FIG. 4B shows third and fourth graphs showing the lateral and radial dynamic stiffness of an exhaust decoupler in a variant of the vehicle exhaust assembly shown in FIG. 1.

The exhaust mounting assembly 4 facilitates a lightweight construction of the exhaust system 3. The mechanical properties of the exhaust mounting assembly 4 which provide this functionality will now be described. As outlined above, the exhaust decoupler 8 has a length of 180 mm to reduce transmittal of vibrations from the inlet section 5 to the intermediate section 6. The exhaust decoupler 8 could be longer, for example 200 mm. The axial mechanical properties of the exhaust decoupler 8 are illustrated in first and second graphs 100, 105 shown in FIG. 4A. The first graph 100 shows the axial dynamic stiffness (N/mm) for an excitation amplitude of 0.2 mm in relation to frequency (Hz); and the second graph 105 shows the axial dynamic stiffness (N/mm) for excitation amplitudes of 0.1 mm and 0.2 mm in relation to frequency (Hz). A first plot 106 in the second graph 105 represents the axial dynamic stiffness for an axial excitation amplitude of 0.1 mm; and a second plot 107 represents the axial dynamic stiffness for an axial excitation amplitude of 0.2 mm. As represented by the dashed lines in the first and second graphs 100, 105, the axial dynamic stiffness of the exhaust decoupler 8 is less than 50 N/mm up to an exciting frequency of 160 Hz. The exhaust decoupler 8 is configured to reduce excitation to less than 0.18 mm at exciting frequencies less than or equal to 500 Hz. The lateral and radial mechanical properties of the exhaust decoupler 8 are illustrated in third and fourth graphs 110, 115 shown in FIG. 4B. The third graph 110 shows the lateral dynamic stiffness (N/mm) for an excitation amplitude of 0.2 mm in relation to frequency (Hz); and the fourth graph 115 shows the radial dynamic stiffness (N/mm) for excitation amplitudes of 0.1 mm and 0.2 mm in relation to frequency (Hz). A first plot 116 in the fourth graph 115 represents the radial dynamic stiffness for a radial excitation amplitude of 0.1 mm; and a second plot 117 represents the radial dynamic stiffness for a radial excitation amplitude of 0.2 mm. As represented by the dashed lines in the third and fourth graphs 110, 115, the dynamic stiffness of the exhaust decoupler 8 is less than 60 N/mm for an exciting frequency less than or equal to 180 Hz.

Figure 5B:
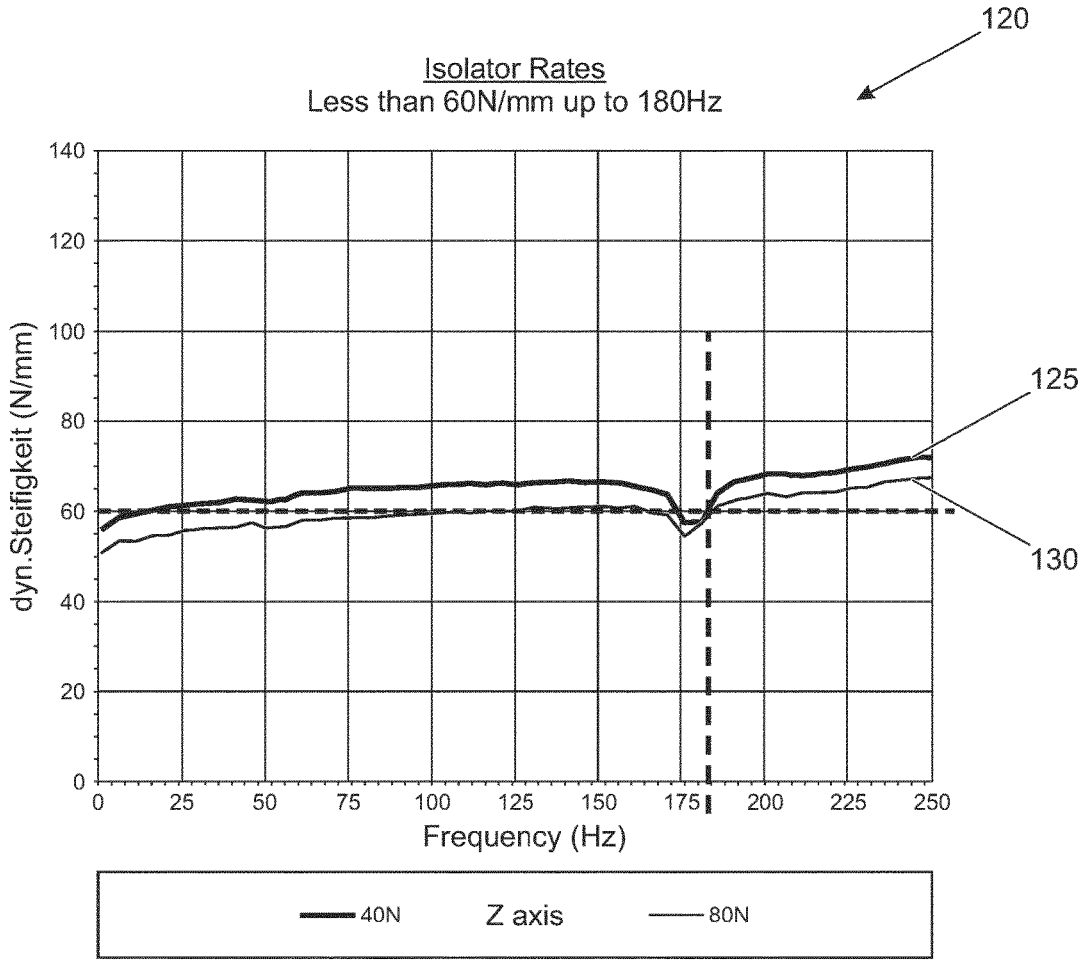
FIG. 5B shows a fifth graph showing the stiffness of the resilient isolator element shown in FIG. 5A.
Figure 5A:
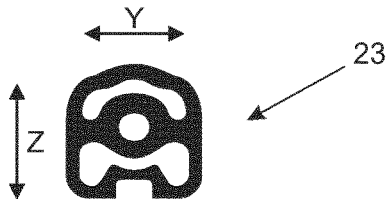
FIG. 5A shows a resilient isolator element for an isolator device of the vehicle exhaust assembly.

The first, second, third and fourth resilient isolator elements 23-1, 23-2, 23-3, 23-4 are made of an elastomeric material, such as a rubber compound. The first, second, third and fourth resilient isolator elements 23-1, 23-2, 23-3, 23-4 can have the same or different mechanical properties. A resilient isolator element 23 is shown in FIG. 5A by way of example. The resilient isolator element 23 in the present embodiment is available from the applicant and has part number C2P13213. The resilient isolator element 23 is illustrated in a YZ plane and a fifth graph 120 illustrating the mechanical properties in the Z-axis is shown in FIG. 5B. In the Y direction, loading is transmitted directly by the resilient isolator element 23 to the housing 22. In the Z direction, shear loading of the resilient isolator element 23 improves isolation performance, since it is free to move within an air gap. The arrangement of the resilient isolator element 23 thereby provides different mechanical properties in the Y and Z directions. The resilient isolator element 23 is configured to negate stiffness behaviours in the X direction (i.e. out-of-plane stiffness). The resilient isolator element has an axial dynamic stiffness along the Z-axis of less than or equal to 60 N/mm up to an excitation frequency of 180 Hz. A first plot 125 in the fifth graph 120 shows the axial dynamic stiffness of the resilient isolator element with a preload of 40 N; and a second plot 130 shows the axial dynamic stiffness of the resilient isolator element with a preload of 80 N. The second plot 130 represents axial dynamic stiffness along the Z-axis which is less than or equal to 60 N/mm (up to an excitation frequency of 180 Hz), as represented by the dashed lines in the fifth graph 120. At least in certain embodiments, the local body interface stiffness should be not less than ten (10) times the dynamic stiffness in a vertical direction.

The resilient isolator element 23 shown in FIG. 5A is representative of the first, second, third and fourth resilient isolator elements 23-1, 23-2, 23-3, 23-4. However, it will be understood that the relative orientation of the resilient isolator element 23 is changed depending on its application. The orientation of the isolator elements 23-1, 23-2, 23-3 affect centre of mass constraints under vehicle dynamic behaviour. When implemented as the first and second resilient isolator elements 23-1, 23-2, the resilient isolator element 23 is disposed in a XZ plane such that the axial dynamic stiffness along the X-axis is less than or equal to 60 N/mm (up to an excitation frequency of 180 Hz). When implemented as the third and fourth resilient isolator elements 23-3, 23-4, the resilient isolator element 23 is disposed in a YZ plane such that the axial dynamic stiffness along the Y-axis is less than or equal to 60 N/mm (up to an excitation frequency of 180 Hz).

At least in certain embodiments of the present invention the vehicle exhaust assembly 1 can result in a mass reduction of approximately 50% (10-15 kg). Moreover, vehicle exhaust assembly 1 can remove the need for structural vibration palliatives to address noise, vibration and harshness (NVH).

The exhaust system 3 has been described as being made of stainless steel. In certain embodiments, stainless steel, such as Inconel, could be used to fabricate the exhaust system 3. It will be appreciated that titanium or other metals could be used in place of stainless steel.

It will be appreciated that changes and modifications can be made to the vehicle exhaust assembly 1 described herein without departing from the scope of the present application. For example, the diameters of the various conduits could be changed from the values specified herein. Likewise, the gauge thickness of the material used to form the conduits could be varied from the values specified herein. Furthermore, it will be appreciated that the geometry of the vehicle exhaust assembly 1 could be modified, for example to suit different vehicles and different powertrain configurations.

The exhaust system 3 has been described as comprising one exhaust decoupler 8 disposed in the inlet section 5. In alternate arrangements, the exhaust system 3 can comprise more than one exhaust decoupler 8. The inlet section 5 could comprise more than one exhaust decoupler 8 disposed in a series arrangement in the inlet conduit 9. Alternatively, the inlet section 5 can comprise a plurality of inlet conduits 9. One or more exhaust decoupler 8 can be disposed in each of said inlet conduits 9. Alternatively, or in addition, the intermediate section 6 can comprise one or more exhaust decoupler. For example, the first and second intermediate conduits 14-1, 14-2 can each comprise one or more exhaust decoupler. An exhaust decoupler can be disposed between the silencer 13 and the first and second intermediate conduits 14-1, 14-2; and/or between the first and second intermediate conduits 14-1, 14-2 and the first and second exhaust silencers 18-1, 18-2. Alternatively, or in addition, the outlet section 7 can comprise one or more exhaust decoupler.

The invention claimed is:

1. A vehicle exhaust assembly for an internal combustion engine, the vehicle exhaust assembly comprising;
- an exhaust system; and
- an exhaust mounting assembly for mounting the exhaust system,
- wherein the exhaust system comprises:
  - an inlet section for connection to the internal combustion engine;
  - an intermediate section connected to the inlet section;
  - an outlet section for exhausting gases from the internal combustion engine; and
  - at least one exhaust decoupler for decoupling the intermediate section from the inlet section, and
- wherein the exhaust mounting assembly comprises:
  - at least one first isolator device for resiliently constraining movement of the intermediate section of the exhaust system in a longitudinal direction and for inhibiting movement of the intermediate section of the exhaust system in a transverse direction; and
  - at least one second isolator device for resiliently constraining movement of the outlet section of the vehicle exhaust in the transverse direction and for inhibiting movement of the outlet section of the exhaust system in the longitudinal direction.

2. The vehicle exhaust assembly as claimed in claim 1, wherein the at least one first isolator device has an axial dynamic stiffness in the longitudinal direction of less than or equal to 60 N/mm up to an excitation frequency of 180 Hz.

3. The vehicle exhaust assembly as claimed in claim 1, wherein the at least one second isolator device has an axial dynamic stiffness in the transverse direction of less than or equal to 60 N/mm up to an excitation frequency of 180 Hz.

4. The vehicle exhaust assembly as claimed in claim 1, wherein the at least one first isolator device comprises a first resilient isolator element moulded from an elastomeric material and/or wherein the at least one second isolator device comprises a second resilient isolator element moulded from an elastomeric material.

5. The vehicle exhaust assembly as claimed in claim 4, wherein the at least one first isolator device comprises a first rigid housing, wherein the first resilient isolator element is moulded into the first rigid housing, and/or wherein the at least one second isolator device comprises a second rigid housing, wherein the second resilient isolator element is moulded into the second rigid housing.

6. The vehicle exhaust assembly as claimed in claim 1, wherein the at least one first isolator device provides greater resilient constraint for the intermediate section in the longitudinal direction than in a vertical direction and/or wherein the at least one second isolator device provides greater resilient constraint for the outlet section in the transverse direction than in the vertical direction.

7. The vehicle exhaust assembly as claimed in claim 6, wherein the at least one first isolator device is configured to support the intermediate section in the vertical direction substantially without resiliently constraining movement in the vertical direction and/or wherein the at least one second isolator device is configured to support the outlet section in the vertical direction substantially without resiliently constraining movement in the vertical direction.

8. The vehicle exhaust assembly as claimed in claim 1, wherein the at least one first isolator device is a single first isolator device.

9. The vehicle exhaust assembly as claimed in claim 1, wherein the at least one second isolator device is a single second isolator device.

10. The vehicle exhaust assembly as claimed in claim 1, wherein the at least one second isolator device comprises two second isolator devices only.

11. The vehicle exhaust assembly as claimed in claim 1, wherein the at least one exhaust decoupler has a length greater than or equal to 180 mm.

12. The vehicle exhaust assembly as claimed in claim 1, wherein the at least one exhaust decoupler is configured to reduce excitation of the intermediate section to less than 0.18 mm at frequencies less than or equal to 500 Hz.

13. The vehicle exhaust assembly as claimed in claim 1, wherein the at least one exhaust decoupler has an axial dynamic stiffness of less than or equal to 50 N/mm up to an excitation frequency of 160 Hz.

14. The vehicle exhaust assembly as claimed in claim 1, wherein the at least one exhaust decoupler has a lateral dynamic stiffness of less than or equal to 60 N/mm up to an excitation frequency of 180 Hz.

15. The vehicle exhaust assembly as claimed in claim 1, wherein the at least one exhaust decoupler comprises one or more of the following: a flexible conduit, a convoluted tube, and a metal braided conduit.

16. The vehicle exhaust assembly as claimed in claim 1, wherein the intermediate section comprises at least one second exhaust decoupler.

17. The vehicle exhaust assembly as claimed in claim 1, wherein the at least one exhaust decoupler is a single exhaust decoupler.

18. The vehicle exhaust assembly as claimed in claim 1, wherein the exhaust system is made of metal sheet having a gauge thickness of between 0.4 mm and 0.7 mm.

19. The vehicle exhaust assembly as claimed in claim 1, wherein the intermediate section of the exhaust system comprises an after-treatment device.

20. A vehicle comprising the vehicle exhaust assembly of claim 1.

* * * * *